United States Patent [19]

Morris et al.

[11] Patent Number: 4,710,676

[45] Date of Patent: Dec. 1, 1987

[54] MULTI-LEVEL FUSER LAMP

[75] Inventors: Merle E. Morris; Lawrence M. Rice, both of Lexington; Steven L. Meade, Winchester, all of Ky.

[73] Assignee: GTE Products Corporation, Danvers, Mass.

[21] Appl. No.: 67,405

[22] Filed: Jun. 25, 1987

Related U.S. Application Data

[63] Continuation of Ser. No. 765,975, Aug. 15, 1985, abandoned.

[51] Int. Cl.[4] ..... H01K 9/00; H01K 1/18

[52] U.S. Cl. ..... 313/579; 313/580; 313/316; 313/1

[58] Field of Search ..... 313/578, 579, 580, 315, 313/316, 1, 272

[56] References Cited

U.S. PATENT DOCUMENTS

| | | | |
|---|---|---|---|
| 3,435,272 | 3/1969 | Green | 313/579 |
| 3,443,144 | 5/1969 | Freese, Jr. | 313/315 |
| 3,867,660 | 2/1975 | Fohl | 313/12 |
| 4,442,374 | 4/1984 | Morris et al. | 313/316 |
| 4,510,416 | 4/1985 | Meade et al. | 313/579 |
| 4,621,220 | 11/1986 | Morris et al. | 313/318 |

*Primary Examiner*—Leo H. Boudreau
*Assistant Examiner*—K. Wieder
*Attorney, Agent, or Firm*—Lawrence R. Fraley

[57] ABSTRACT

A tubular incandescent lamp for use in heating applications where multiple levels of infrared energy are available from one source while providing for compactness in size and ease in manufacturing. The primary use for such a lamp is in the fusing system of a photocopy machine where speed in attaining the desired operating temperature greatly determines the machine's rating. In one embodiment of the lamp, quartz envelope is provided with dual chambers extending longitudinally therethrough. A filament extends longitudinally through each of the chambers and is hermetically sealed within press-sealed ends at the opposed ends of the lamp. The filaments are capable of being selectively or simultaneously activated.

13 Claims, 4 Drawing Figures

MULTI-LEVEL FUSER LAMP

This application is a continuation of application Ser. No. 765,975, filed Aug. 15, 1985, abandoned.

REFERENCE TO CO-PENDING APPLICATION

In a co-pending application having Ser. No. 575,965 (entitled "INCANDESCENT LAMP HAVING TWO LEAD-IN CONDUCTORS SEALED WITHIN ONE END THEREOF" to Morris et al) and a filing data of Feb. 1, 1984, now U.S. Pat. No. 4,621,220, there is defined an improved incandescent lamp having a tubular envelope, a coiled filament, two press sealed end portions and two lead-in conductors that are positioned within one of the press sealed end portions in a spaced apart relationship to energize the filament from the one end portion. The above Application has been assigned to the same assignee as the present invention.

TECHNICAL FIELD

The present invention relates in general to tubular incandescent lamps, and pertains, more particularly, to such lamps as applied in heating or photoreproduction processes.

BACKGROUND

A photocopy machine typically employs two different types of lamps, one being referred to as an exposure lamp and the other as a fusing lamp. The exposure lamp is purely for light emitting purposes during the exposure phase of operation. The fusing lamp on the other hand is primarily for heating purposes to "set" the toner employed in the photocopy machine. In accordance with the present invention, the principles thereof are applied primarily in connection with a fusing lamp, but may also be applied to other general heating purposes.

Fusing lamps are typically of single filament construction and have a length corresponding to the maximum size (length) of paper that is to be reproduced. One infrared lamp, in particular, has utilized two filaments disposed and electrically connected in parallel within a quartz envelope in order to allow substantially higher operating wattages to be achieved by simultaneously energizing both filaments (see U.S. Pat. No. 3,443,144 to Robert Freeze). According to Freeze, the use of parallel filaments provides higher heat density per unit area of envelope wall. The lamp in Freeze, as described, does not provide for selective activation of the filaments (i.e. dual level fusing), to adjust for different incremental wattage output requirements. Finally, the Freeze lamp provides a series of spacers disposed along the length of the filaments to prevent them from sagging against the quartz envelope, but does not isolate the filaments from each other to prevent shorting.

In some photocopier applications it would be desirable to have different levels of energy available for fixing the toner (i.e. fusing) onto the copy of the original document. A high level of energy is desirable at the time of starting to make the first copy, as at that point the fusing system is cold. Typically, some time is required to bring the fusing system up to operating temperature and may limit the speed in which the first copy is supplied, which is one measurement criteria used in photocopying machine evaluation. In U.S. Pat. No. 4,442,374 to Morris et al, a dual length filament incandescent lamp is provided that allows for two different lengths of fusing usually at a prescribed amount of energy per length in order to set toner on short paper and long paper equally, i.e., energy per square centimeter of paper would be the same for both short and long paper. This then will result in two levels of total lamp energy, but one level of fusing energy per length of paper. The specification of Morris et al (U.S. Pat. No. 4,442,374) is hereby incorporated by reference.

It is believed, therefore, that a tubular incandescent lamp providing multiple levels of energy for heating applications while promoting compactness and manufacturing ease would constitute a significant advancement in the art.

DISCLOSURE OF THE INVENTION

It is, therefore, a primary object of this invention to enhance the tubular incandescent lamp art and particularly that art involving lamps having more than one filament.

It is another object of this invention to provide an improved incandescent lamp wherein the lamp is readily adapted for use in applications requiring multiple levels of energy for heating.

Still another object of the invention is to provide an improved incandescent lamp which is compact, can be produced both at a lower cost and on a mass production basis.

In accordance with one aspect of this invention, there is provided a tungsten-halogen incandescent lamp comprising a tubular quartz envelope having first and second press sealed end portions, a pair of coiled tungsten filaments extending longitudinally through the interior of the tubular envelope and a fill gas mixture disposed within the envelope. The lamp further includes first contact means associated with the first press sealed end portion and electrically coupled to a first end of each of the filaments, second contact means associated with the second press sealed end portion and electrically coupled to a second end of one of the filaments, the filament being energized upon application of a predetermined voltage across the first and second contact means, and third contact means associated with the second press sealed end portion and electrically coupled to an unattached second end of one of the filaments, the filament being energized upon application of a predetermined voltage across the first and third contact means. Finally, the lamp also includes means for electrically isolating each of the filaments, the electrically isolating means disposed within and extending longitudinally through the interior of the envelope.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
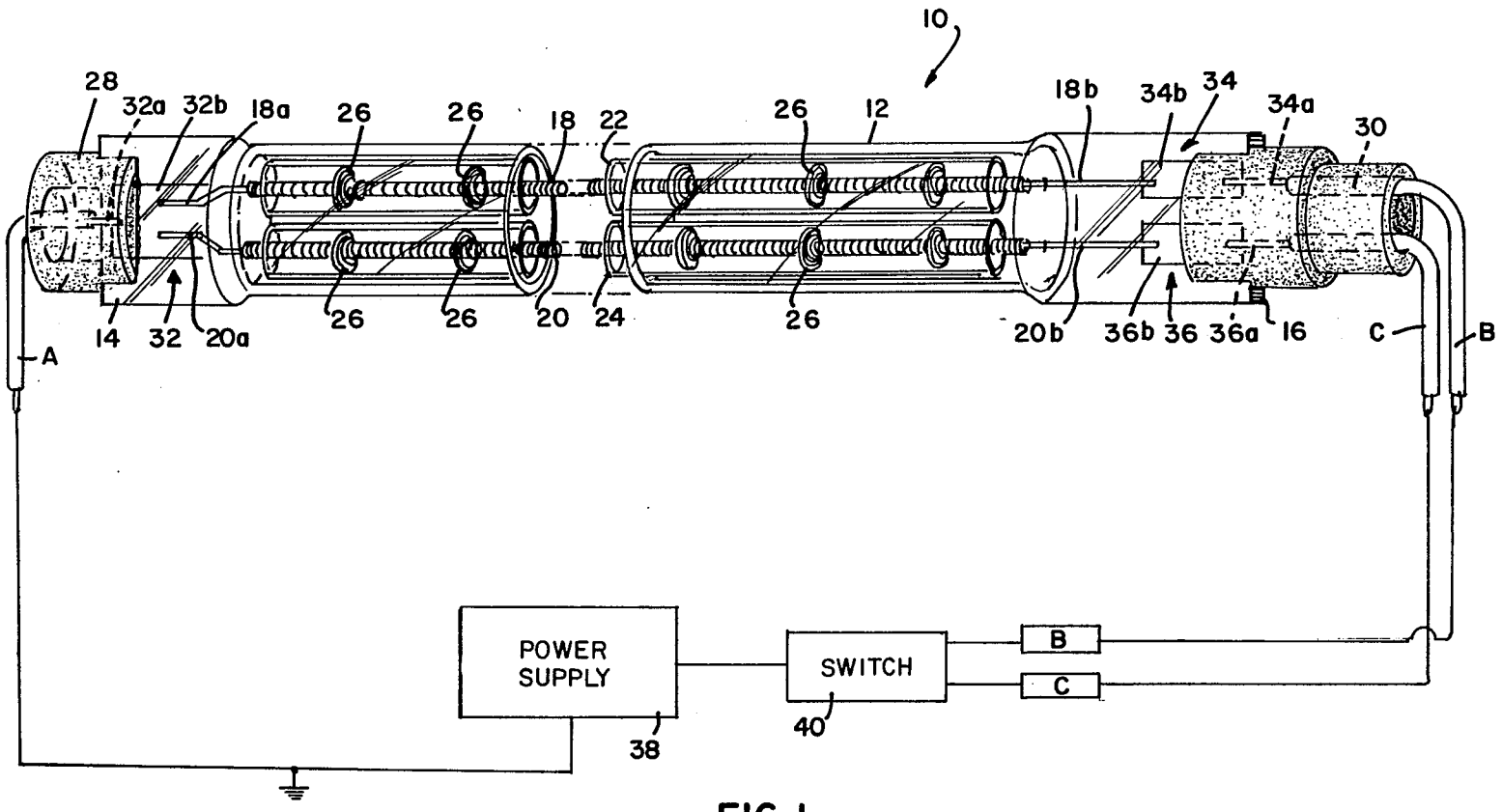
FIG. 1 is a side view, partly in section, illustrating one embodiment of the instant invention and furthermore illustrating the electrical switching control associated with the lamp.

With particular attention to FIG. 1, a lamp 10 is illustrated which comprises a tubular envelope 12 of vitreous material having first and second press-sealed end portions 14 and 16, respectively. Ends 14 and 16 are located at the opposed ends of envelope 12 and are formed by utilizing pressing operations and apparatus known in the art. Envelope 12 should preferably be made of a material having a high melting point, such as fused silica or quartz.

Lamp 10 is of the tungsten-halogen variety, therefore it has a fill gas mixture containing an inert gas and a halogen or halide. In the present invention, the lamps are filled at about one atmosphere of argon (as the inert gas) and have about 200 micrograms of bromine (specifically methyl bromide). The preceding fill constituents should serve only to illustrate what the compositional make-up of a fill gas mixture normally consists of and not serve to limit the present invention. Lamp 10 further includes a pair of tungsten filaments, 18 and 20, which are disposed within envelope 12 and extend longitudinally through the interior of the envelope.

Previous lamps, especially the lamp in the Freeze patent (U.S. Pat. No. 3,443,144), have typically included means for spacing or supporting the filament to prevent it from touching the envelope wall. The drawbacks to utilizing the spacer means provided in Freeze involves the difficulty of inserting such a spacer within a mass produced lamp envelope and the insufficiently of electrical isolation between filaments to prevent possible shorting. Accordingly, the instant invention uniquely provides means for electrically isolating the filaments while promoting compactness and simplifying assembly of the lamp.

In accordance with the teachings of the present invention, filaments 18 and 20, as illustrated in FIG. 1, are electrically isolated from one another by isolating means, comprising two tubes, 22 and 24, that are disposed longitudinally within envelope 12. Filaments 18 and 20 extend longitudinally through tubes 22 and 24, respectively. Tubes 22 and 24 should be made of electrically insulative material that is transparent and has a high melting point, such as quartz. Tubes 22 and 24 extend the length of the interior of envelope 12 to about 1 millimeter (mm) from press sealed end portions 14 and 16. The filaments could conceivably be sufficiently electrically isolated by using one tube about one of the filaments. The filaments are also hermetically sealed within end portions 14 and 16.

Supporting filaments 18 and 20 at preselected points (about 25.4 mm apart) along the length thereof are a plurality of support members 26 (illustrated in FIG. 1), each comprising a coil element having one end wound about (and thus secured to) each of filaments 18 and 20 and the other end (of greater diameter) positively engaging the interior wall of tubes 22 and 24, respectively. In the embodiment illustrated in FIG. 1, filaments 18 and 20 possessed an overall length of about 350 mm. In addition, envelope 12 is a T-5 quartz tube having an outer diameter of about 15 mm with a thickness of about 1 mm. Tubes 22 and 24 are T-2 quartz tubes having outer diameters of about 6 mm and thicknesses of about 1 mm.

To facilitate positioning of lamp 10 within the photocopier designed for utilizing same, ceramic bases or end caps 28 and 30 are preferably used. Accordingly, it is only necessary in the respective photocopier to provide some means for accepting this component. Understandably, such a means can be of relatively simple design. Ceramic bases 28 and 30 are also preferably of substantially cylindrical configuration and include a slot therein designed for having the flattened press-sealed end portions, 14 and 16, inserted therein.

Filaments 18 and 20 are energized by means of applying a predetermined voltage across contact means located within the press sealed end portions of lamp 10. Specifically, first contact means 32 is associated with end portion 14, while second contact means 34 and third contact means 36 are associated with end portion 16. First contact means 32 is comprised of a first lead-in conductor **32*a*, which extends externally from and internally within end portion 14, and a foil portion 32*b* disposed within portion 14 and electrically coupled to both conductor 32*a* and to a first end 18*a* and 20*a* of filaments 18 and 20, respectively. Second contact means 34 is comprised of a second lead-in conductor 34*a*, which extends externally from and internally within end portion 16, and a foil portion 34*b* disposed within portion 16 and electrically coupled to both conductor 34*b* and to a second end 18*b* of filament 18. Finally, third contact means 36 is comprised of a third lead-in conductor 36*a*, extending externally from and internally within end portion 16, and a foil portion 36*b* disposed within end portion 16 and electrically coupled to both conductor 36*a* and to an unattached second end 20*b* of filament 20**.

Lead-in conductor 32 is coupled to a lead wire A, which is in turn coupled to the common terminal of a power source 38. Lead-in conductors 34 and 36 are coupled to lead wires B and C, respectively, while wires B and C are then coupled to a control switch 40 that is coupled to power source 38. Leads A, B and C are stranded 16 AWG (AWG=American Wire Gauge) teflon insulated wire which is rated at 600 V and 200° C. Lead wires B and C, through switch 40, are adapted to apply a voltage across filaments 18 and 20, individually or simultaneously. Filaments 18 and 20 may be of varying wattages, but the total wattage output of filaments 18 and 20 together must be greater than either individually. In one embodiment of the present invention, filament 18 is rated at about 375 watts (120 V) and filament 20 is rated at about 1250 watts (120 V); the overall wattage output possible in lamp 10 would thus be about 1625 watts. The overall length of lamp 10 is about 420 mm.

Figure 2A:
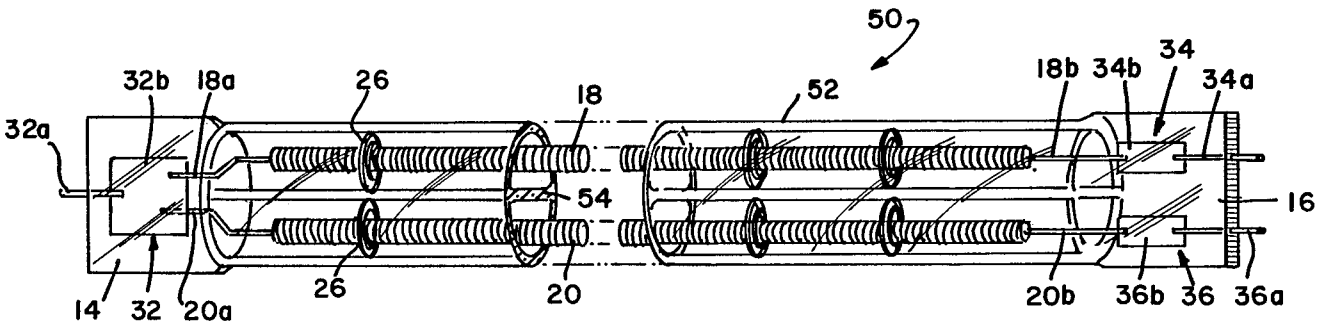
FIGS. 2A–2C illustrate several views of another embodiment of the instant invention.
Figure 2C:
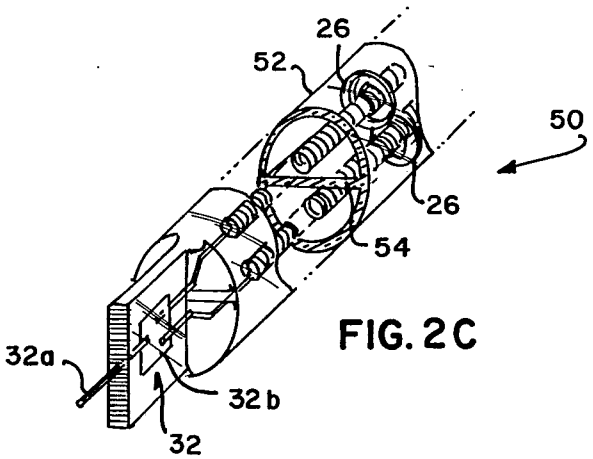
Figure 2B:
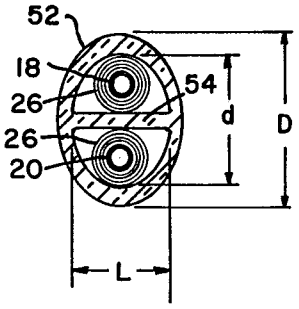

Referring now to FIGS. 2A–2C, a lamp 50 is illustrated which is made in accordance with the teachings of the present invention. The elements of lamp 50 that are common with those of lamp 10 have been similarly numbered and a detailed description of these elements is not believed necessary here (see FIG. 2A). Lamp 50 has an envelope 52 which contains therein isolating means 54, which isolates filament 18 from filament 20, that extends longitudinally therethrough. Isolating means 54 comprises an insulative divider which forms at least two chambers within envelope 52 (see FIG. 2B). In lamp 50, divider 54 is structurally a part of envelope 52 and extends to press sealed end portions 14 and 16 (as partially illustrated in FIG. 2C). As illustrated in FIGS. 2A and 2B, divider 54 is substantially planar in configuration and forms dual chambers within envelope 52 which are sealed at end portions 14 and 16.

In lamp 50, envelope 52 and divider 54 are formed from quartz and may be formed in a single manufacturing step by forming a quartz tube with dual bores or chambers. As seen in FIGS. 2B and 2C, the quartz tube (or envelope 52) may have an elliptical shape with two dome-shaped chambers within. In this embodiment of lamp 50 (see FIG. 2B), the tube has a diameter "D" of about 15 mm (millimeters), with an inner diameter "d" of about 13 mm. Divider 54 has a length "L" of about 11 mm and the diameter of each chamber is about 6 mm. Divider 54 of lamp 50 need not be a part of envelope 52, but need simply be an insert that provides a similar function as described earlier. Accordingly, the instant invention uniquely provides means for isolating the filaments while promoting compactness and simplifying assembly of the lamp.

Lamp 50 is similar to lamp 10 with respect to filament lengths and wattages, fill gas mixture, overall lamp length, lead wire connections and lamp-circuit connection. Lamps 10 and 50 are lamps which provide infrared heating primarily for photocopier machine applications but are not limited to such applications. These lamps provide multiple levels of fusing energy per square centimeter of paper regardless of the design length, depending on the demands arising from the particular application, without unnecessarily complicating the production of such a lamp. Presently, the filament length may be designed at a fixed length as needed for the particular application, but means are provided for varying the amount of energy per square centimeter of paper by burning either filament separately or simultaneously to provide at least three levels of fusing energy total and per square centimeter of paper.

Infrared lamps made in accordance to the teachings of the present invention will significantly improve a photocopy machine fusing system's speed in achieving start-up temperatures. For example, using the wattages already described earlier for lamps 10 and 50, at start-up 1625 watts of energy (both filaments energized) is supplied to the fusing system. Shortly thereafter (about 1 or 2 photocopies later) the energy needed would shift to 1250 watts (one filament) and then perhaps to 375 watts (alternate filament), still supplying enough energy to fix the toner properly to the paper. Depending on the fusing system, the higher wattage filament may be used for fusing and switching could be controlled by a thermostat that could switch between filaments of different wattages as needed.

While there have been shown and described what are at present considered the preferred embodiments of the invention, it will be obvious to those skilled in the art that various changes and modifications may be made therein without departing from the scope of the invention as defined by the appended claims.

What is claimed is:

1. A tungsten-halogen, incandescent heating lamp for use in a photocopier, said lamp comprising;

a tubular quartz envelope having first and second press sealed end portions;

first and second coiled tungsten filaments extending longitudinally through the interior of said tubular envelope;

a fill gas mixture disposed within said envelope;

first contact means associated with said first press sealed end portion and electrically coupled to a first end of each of said first and second filaments;

second contact means associated with said second press sealed end portion and electrically coupled to a second end of said first filament, said first filament being energized upon application of a predetermined voltage across said first and second contact means to provide a first level of heating energy from said lamp along a given length of said lamp;

third contact means associated with said second press sealed end portion and electrically coupled to a second end of said second filament, said second filament being energized upon application of a predetermined voltage across said first and third contact means to provide a second level of heating energy from said lamp along said same given length of said lamp, said second level of heating energy different from said first level of said heating energy; and means for electrically isolating said first and second filaments, said isolating means disposed within and extending longitudinally through the interior of said envelope, said lamp providing a third level of heating energy from said lamp along said same given length of said lamp substantially equal to the total of said first and second levels of heating energy upon simultaneous application of a predetermined voltage across said first and second contact means and across said first and third contact means, said lamp thereby providing three different levels of heating energy along said same given length of said lamp and per square centimeter of paper heated by said lamp within said photocopier, said isolating means comprised of electrically insulative material and including at least one quartz tube disposed within said coiled tungsten filaments therein.

2. The lamp according to claim 1 wherein said isolating means includes two quartz tubes disposed longitudinally within said envelope, each of said tubes having one of said filaments extending longitudinally therethrough.

3. The lamp according to claim 1 wherein said first contact means is comprised of a first lead-in conductor extending externally from and internally within said first press sealed end portion and a foil portion disposed within said first press sealed end portion and electrically coupled to said first lead-in conductor and to said first end of each of said filaments.

4. The lamp according to claim 3 wherein said second contact means is comprised of a second lead-in conductor extending externally from and internally within said second press sealed end portion and a foil portion disposed within said second press sealed end portion and electrically coupled to said second lead-in conductor and to said second end of said first filament.

5. The lamp according to claim 4 wherein said third contact means is comprised of a third lead-in conductor extending externally from and internally within said second press sealed end portion and a foil portion disposed within said second press sealed end portion and electrically coupled to said third lead-in conductor and to said second end of said second filament.

6. The lamp according to claim 1 wherein said lamp is used to set the toner on said paper used in said photocopier.

7. A tungsten-halogen, incandescent heating lamp for use in a photocopier, said lamp comprising:

a tubular quartz envelope having first and second press sealed end portions;

first and second coiled tungsten filaments extending longitudinally through the interior of said tubular envelope;

a fill gas mixture disposed within said envelope;

first contact means associated with said first press sealed end portion and electrically coupled to a first end of each of said first and second filaments;

second contact means associated with said second press sealed end portion and electrically coupled to a second end of said first filament, said first filament being energized upon application of a predetermined voltage across said first and second contact means to provide a first level of heating energy from said lamp along a given length of said lamp;

third contact means associated with said second press sealed end portion and electrically coupled to a second end of said second filament, said second filament being energized upon application of a predetermined voltage across said first and third contact means to provide a second level of heating energy from said lamp along said same given length of said lamp, said second level of heating energy different from said first level of said heating energy; and means for electrically isolating said first and second filaments, said isolating means disposed within and extending longitudinally through the interior of said envelope, said lamp providing a third level of heating energy from said lamp along said same given length of said lamp substantially equal to the total of said first and second levels of heating energy upon simultaneous application of a predetermined voltage across said first and second contact means and across said first and third contact means, said lamp thereby providing three different levels of heating energy along said same given length of said lamp and per square centimeter of paper heated by said lamp within said photocopier, said isolating means comprised of electrically insulative material and including an insulative divider forming a structural part of said envelope and extending longitudinally through said envelope to form at least two chambers within said envelope such that each of said coiled filaments is located within a respective one of said chambers.

8. The lamp according to claim 7 wherein said divider is substantially planar in configuration, said chambers formed by said divider and said envelope being sealed at said sealed end portions.

9. The lamp according to claim 7 wherein said divider is comprised of quartz.

10. The lamp according to claim 7 wherein said first contact means is comprised of a first lead-in conductor extending externally from and internally within said first press sealed end portion and a foil portion disposed within said first press sealed end portion and electrically coupled to said first lead-in conductor and to said first end of each of said filaments.

11. The lamp according to claim 10 wherein said second contact means is comprised of a second lead-in conductor extending externally from and internally within said second press sealed end portion and a foil portion disposed within said second press sealed end portion and electrically coupled to said second lead-in conductor and to said second end of said first filament.

12. The lamp according to claim 11 wherein said third contact means is comprised of a third lead-in conductor extending externally from and internally within said second press sealed end portion and a foil portion disposed within said second press sealed end portion and electrically coupled to said third lead-in conductor and to said second end of said second filament.

13. The lamp according to claim 7 wherein said lamp is used to set the toner on said paper used in said photocopier.

* * * * *